US006434774B1

(12) United States Patent
Castellon

(10) Patent No.: US 6,434,774 B1
(45) Date of Patent: Aug. 20, 2002

(54) MOTORIZED BRUSH

(76) Inventor: Reidel Castellon, 201 W. 18 St., Hialeah, FL (US) 33013

( * ) Notice: Subject to any disclaimer, the term of this patent is extended or adjusted under 35 U.S.C. 154(b) by 0 days.

(21) Appl. No.: 09/728,334

(22) Filed: Dec. 1, 2000

(51) Int. Cl.[7] ..... A47L 11/162; A47L 11/03
(52) U.S. Cl. ..... 15/50.1; 15/29
(58) Field of Search ..... 15/24, 29, 50.1, 15/50.3, 97.1, 98

(56) References Cited

U.S. PATENT DOCUMENTS 1,821,715 A * 9/1931 Kuchinsky
1,925,925 A * 9/1933 Kintzing
3,512,204 A * 5/1970 Jagiel
4,780,992 A 11/1988 McKervey
5,146,642 A * 9/1992 Mank et al.
5,261,140 A * 11/1993 Szymanski
5,881,418 A * 3/1999 Enoch
5,964,003 A * 10/1999 Rogers
6,170,108 B1 * 1/2001 Knight

* cited by examiner

*Primary Examiner*—Terrence R. Till
(74) *Attorney, Agent, or Firm*—J. Sanchelima; A. Bordas

(57) ABSTRACT

A motorized brush apparatus including a supply of a fluid, such as water, that is selectively actuated upon a targeted surface. A switch allows a user to selectively interrupt the rotational movement applied to a rotating brush assembly at one end of a shaft. A motor assembly is mounted preferably at the other end of the shaft. A source of a fluid is connected to a conduit member that extends along the shaft and ends with an outlet that directs the fluid axially and in parallel with the rotating bristles. The bristles are perpendicularly mounted to a rotating base plate provided with arched openings that allow the fluid to pass through.

3 Claims, 2 Drawing Sheets

MOTORIZED BRUSH

BACKGROUND OF THE INVENTION

1. Field of the Invention

The present invention relates to a motorized brush, and more particularly, to such a motorized brush that is used for cleaning and being equipped with a selective supply of water or other fluids.

2. Description of the Related Art

Many designs for brushed have been designed in the past. None of them, however, include a rotating brush with a simultaneous supply of a fluid, such as water, applied to the area being cleaned.

Some of the previous designs attempt to provide a flow of water that is directed to the brush itself instead of the area being cleaned. This results in the water being diverted away from the area being cleaned by the rotating bristles. The present invention overcomes this problem by directing the water internally and axially from the rotating brush, substantially parallel with the bristles.

Applicant believes that the closest reference corresponds to U.S. Pat. No. 4,780,992 issued to McKervey on Nov. 1, 1988 for Apparatus for Cleaning Pool Tile. The McKervey's patent describe an abrasion member detachably mounted at the end of the rotatable drive shaft of a string trimmer and a separate dispensing unit for delivery cleaning fluid to the surface of the abrasion member. However, it differs from the present invention because in the present invention the water is contained within a cover assembly in a base plate with openings conveniently located to permit the water to pass through. Also, in present invention the end of the hose is perpendicularly mounted to said holes for dispensing water effectively. The present invention also includes a cover mounted to the brush assembly to avoid the splashing of the water dispensed by the hose by rotatory movement of the brush.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a motorized brush apparatus with a supply of a fluid to aid in cleaning surfaces.

It is another object of this invention to provide a motorized brush apparatus that can be readily handled by a user.

It is still another object of the present invention to provide a volumetrically efficient apparatus that can be readily stored and transported.

It is still another object of the present invention to provide a motorized brush that can be used without splashing water to surrounding areas.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 2:
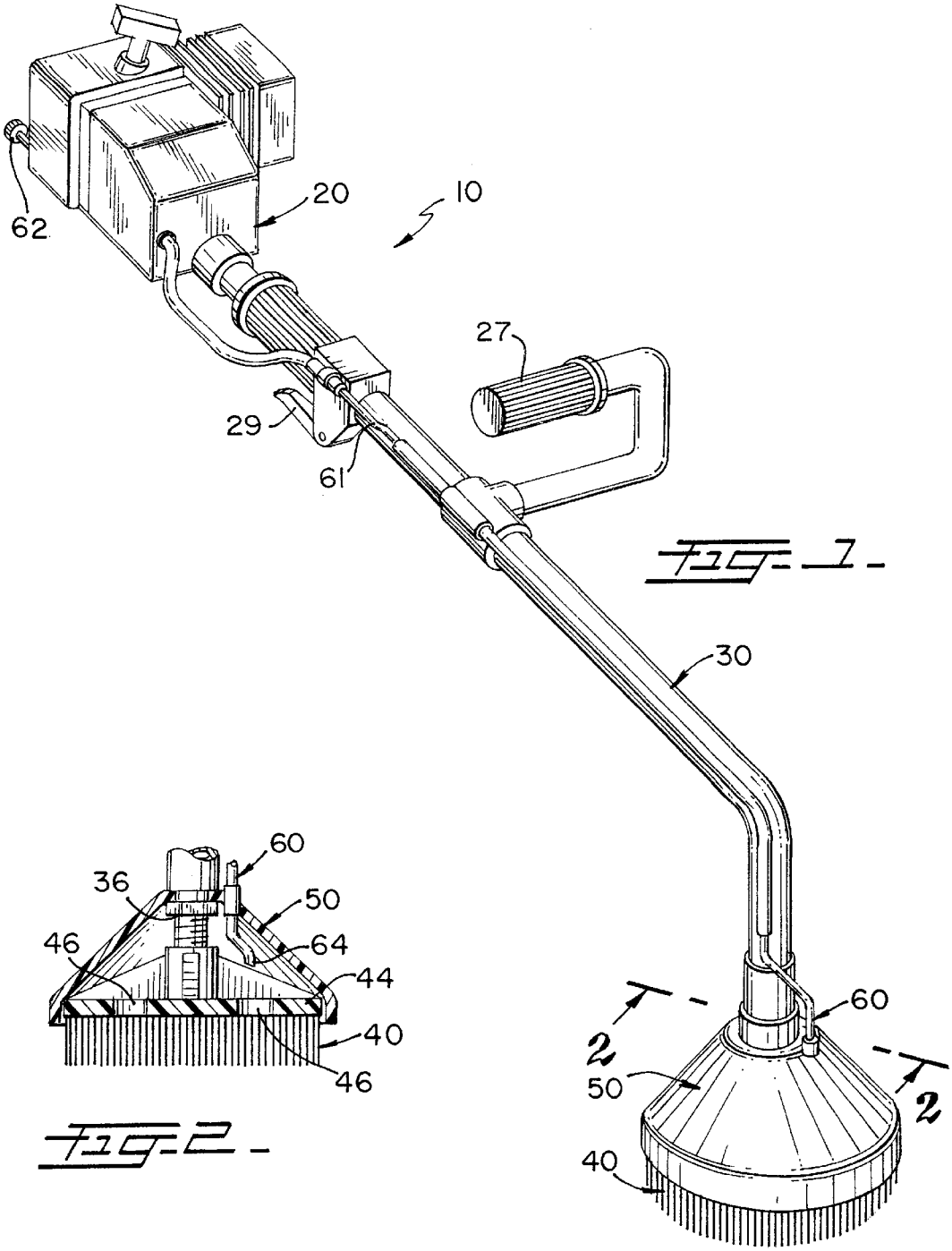
FIG. 1 represents an isometric view of one of the preferred embodiments for the present invention.
FIG. 2 shows a cross-sectional view of the brush and cover assemblies taken along line 2—2 on FIG. 1.

Referring now to the drawings, where the present invention is generally referred to with numeral 10, it can be observed that it basically includes a shaft assembly 30 with motor assembly 20 mounted preferably at one end, and the other end having a rotatably mounted brush assembly 40 driven by motor assembly 20. The mechanism for transmitting a rotational force to brush assembly 40 is known since it is similar to those provide to conventional grass trimmers for janitorial use. A fluid supply assembly 60 is shown in FIG. 1 to include conduit 61 that ends with inlet 62 at one end of shaft assembly 30, in the preferred embodiment. The other end of conduit 61 ends with nozzle outlet 64 inside fixed cover 50. Inlet 62 is connected to a fluid supply, such as water. Other fluids can also be used depending on the application.

Motor assembly 20 is selectively interrupted with switch assembly 29 in a conventional manner. A user typically holds motor brush 10 by handle 27 and directs brush assembly 40 by pushing on shaft assembly 30 to apply the required pressure against the surface being cleaned.

Figure 3:
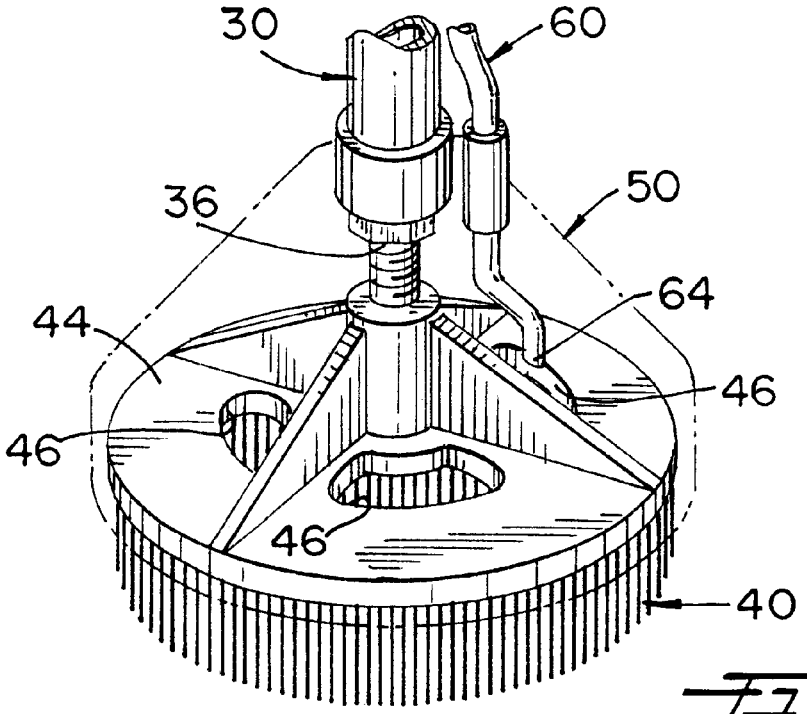
FIG. 3 illustrates an isometric view of the brush assembly, with the cover assembly in phantom, to show the location of the arched openings in one of the preferred embodiments, to facilitate the flow of water.

In FIG. 2, a cross-section of brush and cover assemblies 40 and 50, respectively, has been shown. Brush assembly 40 has a base plate 44 that is rotatably mounted to bearing end 36 that houses the end of a driving flexible member. Outlet 64 directs the water to base plate 44 so that it passes through openings 46, as shown in FIG. 3. Cover assembly 50 and base plate 44 coact to prevent the fluid from being spilled to surrounding areas. Openings 46 have an arcuated shape to increase their exposure to the jet of water passing through. Plates 44 can have openings of different dimensions so that depending on which one a user selects there will be more or less water going through.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A motorized brush apparatus, comprising:

A) an elongated shaft assembly having first and second ends;

B) motor means for imparting a rotational movement mounted to said shaft assembly;

C) a brush assembly rotatably mounted to said first end, said brush assembly including a cover assembly rigidly mounted to said first end and said brush assembly further including a rotating base plate having a plurality of bristles extending perpendicularly therefrom, said base plate further including a plurality of openings adapted to permit the flow of the fluid from said outlet to travel substantially axially with respect to said bristles; and D) a fluid conduit assembly having third and fourth ends, said fluid conduit assembly being mounted to said shaft assembly and said third end including an inlet connected to a fluid supply and said fourth end further including an outlet connected to said brush assembly so that said fluid is directed to an area being cleaned by said rotating brush.

2. The motorized brush apparatus set forth in claim 1 further including switch means for selectively interrupting the rotational movement imparted by said motor means.

3. The apparatus set forth in claim 2 wherein said cover assembly and said rotating base are cooperatively mounted with respect to each other that the fluid is prevented from being spilled to surrounding areas.

* * * * *